US005478219A

United States Patent [19]

Nardone et al.

[11] Patent Number: 5,478,219

[45] Date of Patent: Dec. 26, 1995

[54] LIGHTWEIGHT SCROLL ELEMENT AND METHOD OF MAKING

[75] Inventors: Vincent C. Nardone, South Windsor; Karl M. Prewo, Vernon; James R. Strife, South Windsor, all of Conn.

[73] Assignee: Carrier Corporation, Syracuse, N.Y.

[21] Appl. No.: 200,088

[22] Filed: Feb. 22, 1994

[51] Int. Cl.[6] ..... F01C 1/04; F01C 21/08

[52] U.S. Cl. ..... 418/55.2; 418/55.5; 418/56; 418/57; 418/152; 418/179; 29/888.022

[58] Field of Search ..... 418/55.2, 55.5, 418/56, 57, 152, 179; 29/888.022

[56] References Cited

U.S. PATENT DOCUMENTS

| | | | |
|---|---|---|---|
| 4,540,355 | 10/1985 | Sakaki et al. | 418/55.2 |
| 4,838,936 | 6/1989 | Akechi | 75/249 |
| 5,255,729 | 10/1993 | Cook | 164/97 |

FOREIGN PATENT DOCUMENTS

| | | | |
|---|---|---|---|
| 0508426 | 10/1992 | European Pat. Off. . | |
| 57-73886 | 5/1982 | Japan | 418/56 |
| 62-263859 | 4/1988 | Japan . | |
| 63-045485 | 7/1988 | Japan . | |
| 2112685 | 4/1990 | Japan | 418/56 |
| 2245490 | 10/1990 | Japan | 418/55.2 |
| 3156189 | 7/1991 | Japan | 418/179 |
| 4000332 | 4/1992 | Japan . | |
| 4136492 | 5/1992 | Japan | 418/55.2 |
| 5-44401 | 2/1993 | Japan | 418/56 |
| 4347385 | 4/1993 | Japan . | |
| 5113181 | 5/1993 | Japan | 418/55.2 |
| 6049560 | 5/1994 | Japan . | |

*Primary Examiner*—John J. Vrablik

[57] ABSTRACT

An orbiting scroll is made with a ceramic particle reinforced aluminum metal matrix composite. The resultant part has increased wear resistance, closer thermal expansion matching with cast iron, can be used without tip seals and offers the advantages associated with a reduced mass. In manufacturing the part, the part is pressure cast to a near net shape and machined to the final shape.

4 Claims, 2 Drawing Sheets

LIGHTWEIGHT SCROLL ELEMENT AND METHOD OF MAKING

BACKGROUND OF THE INVENTION

In a scroll machine such as a pump, compressor or expander, there is one basic coaction between the scroll elements in that one must orbit with respect to the other. In the case of a compressor, the fluid being compressed exerts a force on the scroll elements tending to separate them axially and to radially separate the wraps of the scroll elements. To achieve the necessary sealing for compressor operation some form of axial and radial compliance are required. Axial compliance may take the form of discharge or intermediate pressure acting on the plate of the orbiting scroll so as to bias the tips of the wrap of the orbiting scroll into engagement with the floor of the fixed scroll. Another form of axial compliance is the tip seal which is located in a groove in the wrap tip. A tip seal may also be used to avoid contact between the tip of the wrap of one scroll element and the floor of the facing scroll element.

Inertia considerations may sometimes dictate that the orbiting scroll be as lightweight as possible. Based upon a weight consideration, aluminum is a desirable material for the orbiting scroll. Wear characteristics of aluminum may dictate the use of a tip seal to avoid wear of the tip of the wrap as well as to avoid seizure. Because of the machining requirements for the groove to receive the tip seal and leakage problems associated with the use of a tip seal, it is generally preferred to avoid the use of a tip seal. However, the use of aluminum scroll elements without tip seals has been unsatisfactory in the prior art.

SUMMARY OF THE INVENTION

A ceramic particle reinforced aluminum matrix composite is produced to near net shape by a pressure casting process such as die casting or squeeze casting. After die casting, the part is machined to its final shape. The ceramic particle additions enhance scroll performance by providing increased stiffness, increased wear resistance and closer thermal expansion matching to cast iron for a situation when the mating scroll is made from cast iron. These characteristics will be identical where both the fixed and orbiting scrolls are made of the same ceramic particle reinforced aluminum alloy or very close if different alloys are used. This would have all of the benefits plus the additional weight reduction of the fixed scroll. Further, the use of ceramic particle reinforced aluminum eliminates the need for a tip seal and bearing insert or bushing.

It is an object of this invention to provide an aluminum matrix composite orbiting scroll for use in conjunction with an aluminum matrix composite or cast iron scroll without the use of tip seals.

It is another object of this invention to increase the speed range for variable speed applications by reducing the inertial load of the orbiting scroll.

It is a further object of this invention to improve initial wear-in time and to reduce leakage paths.

It is an additional object of this invention to provide an aluminum matrix composite orbiting scroll having a coefficient of thermal expansion and modulus of elasticity comparable with those of cast iron. These objects, and others as will become apparent hereinafter, are accomplished by the present invention.

Basically, a silicon carbide particle reinforced aluminum metal matrix composite orbiting scroll is provided such that desirable physical properties of cast iron are approached or matched permitting its use with a fixed scroll of cast iron or aluminum metal matrix composite.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
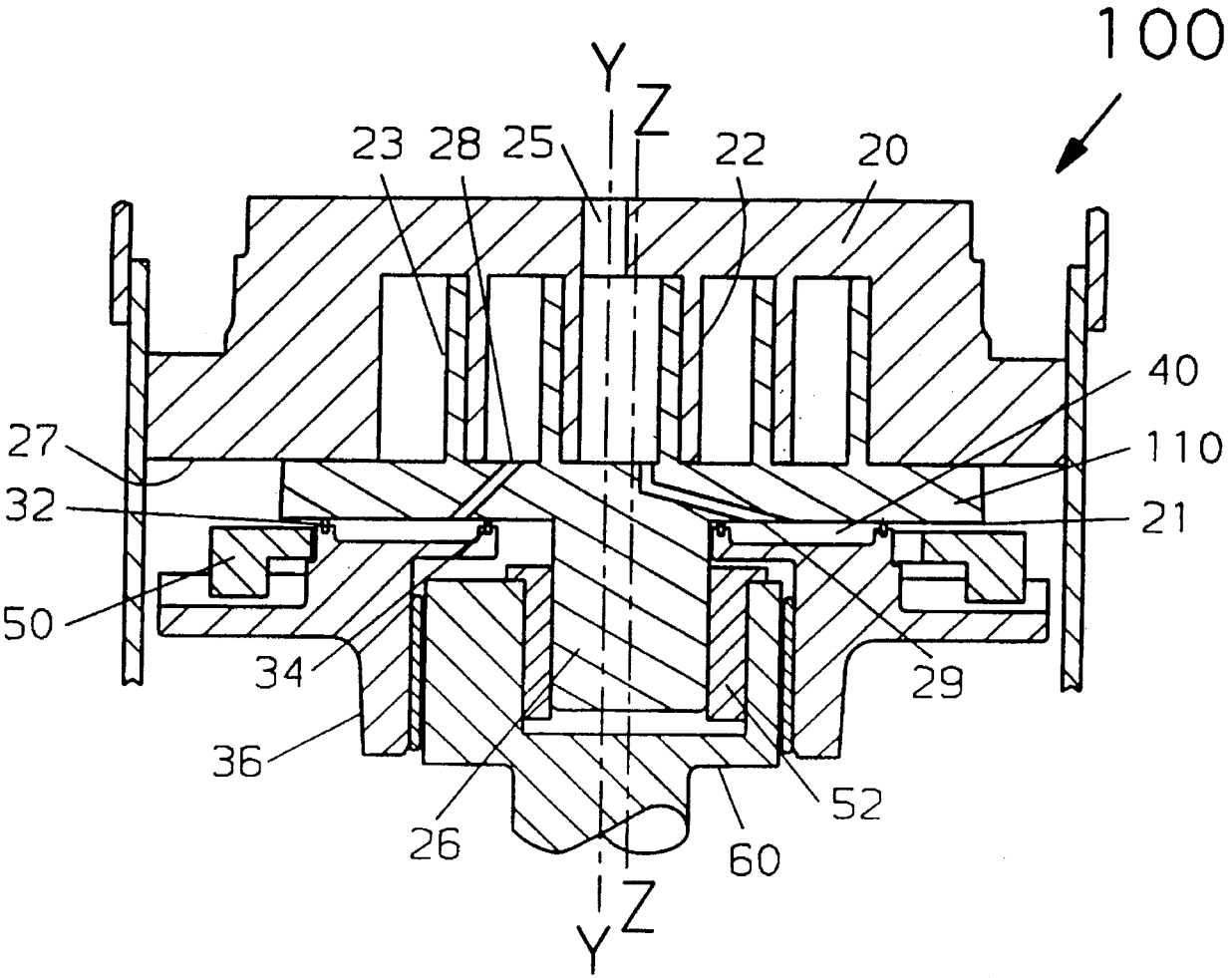
FIG. 1 is a partial, vertical sectional view of a hermetic scroll compressor employing the present invention.
Figure 2:
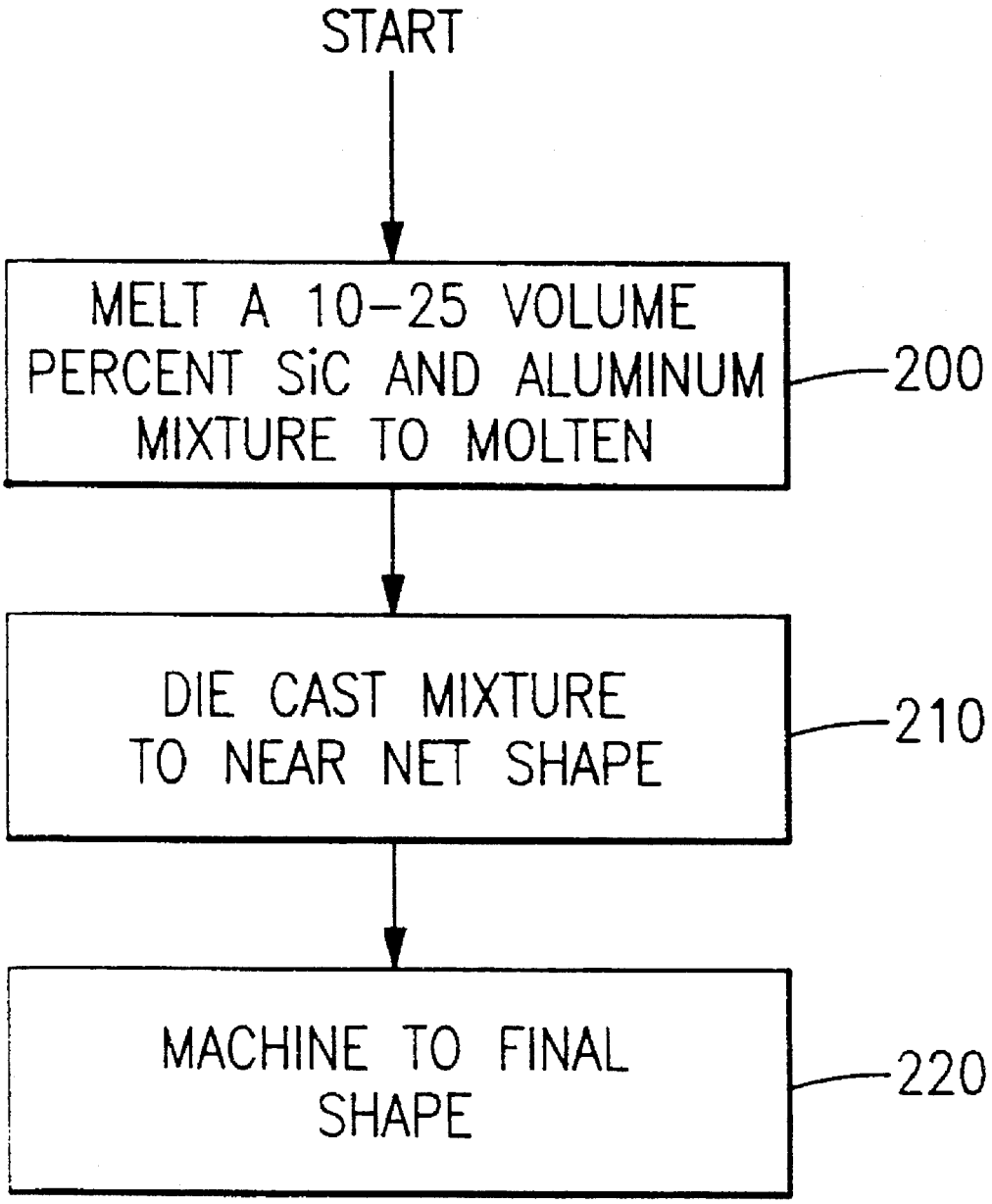
FIG. 2 is a flow diagram showing the steps of making an orbiting scroll.

In FIG. 1, the numeral 100 generally designates a hermetic scroll compressor. Pressurized fluid, typically a blend of discharge and intermediate pressure, is supplied via bleed holes 28 and 29 to annular chamber 40 which is defined by the back of orbiting scroll 21, annular seals 32 and 34 and crankcase 36. The pressurized fluid in chamber 40 acts to keep orbiting scroll 21 in engagement with the fixed scroll 20, as illustrated. The area of chamber 40 engaging the back of orbiting scroll 21 and the pressure in chamber 40 determines the compliant force applied to orbiting scroll 21. Specifically, the tips of wraps 22 and 23 will directly engage the facing floor of scrolls 21 and 20, respectively, and the outer portion of the floor or plate 110 of orbiting scroll 21 engages the outer surface 27 of the fixed scroll 20 due to the biasing effects of the pressure in chamber 40. As is conventional, orbiting scroll 21 is held to orbiting motion by Oldham coupling 50. Orbiting scroll 21 has a hub 26 which is received in slider block 52, without the need for a bearing insert, and driven by crankshaft 60 which is secured to the rotor of a motor (not illustrated). Slider block 52 is capable of reciprocating movement with respect to crankshaft 60 and thereby serves to permit radial compliance of orbiting scroll 21 to keep the flanks of wraps 22 and 23 in sealing contact while permitting the overriding of liquid slugs or the like. Crankshaft 60 rotates about its axis Y—Y, which is also the axis of fixed scroll 20, and orbiting scroll 21, having axis Z—Z, orbits about axis Y—Y. Compressed gas passes into the shell via discharge port 25 and subsequently is discharged into the refrigeration or air conditioning system (not illustrated).

Orbiting scroll 21 differs from conventional scrolls in that it is made from a silicon carbide particle reinforced aluminum metal matrix composite and is used in conjunction with a cast iron fixed scroll 20 without the use of tip seals or a wear plate. However, the fixed scroll can also be of silicon carbide particle reinforced aluminum metal matrix composite. Additionally, no separate bearing is required between hub 26 and slider block 52.

The ceramic particle reinforced aluminum metal matrix composite contains 10 to 25 volume percent of silicon carbide particles. A mixture of 20% by volume of silicon carbide is preferred with 380 aluminum. At this mixture, the elastic modulus ($10^6$ lb/in$^2$) is 16.5 as compared to 15.5 for cast iron. Similarly, the thermal expansion coefficient ($\times 10^{-6}$/° F.) is 9.2 as compared to 6.0 for cast iron. As indicated by box 200, the mixture is heated to form a molten metal. The molten metal is pressure cast, such as by die casting, as indicated by box 210, to produce an orbiting scroll to near net shape. Because the wear resistance of the aluminum metal matrix composite makes machining difficult, the pressure casting to near net shape is important to minimize the amount of material that has to be machined away. After casting, the part is machined to its final shape as indicated by box 220. The part is then ready to be assembled into compressor 100.

Although the present invention has been described in terms of an orbiting scroll, it can be used in other situations where aluminum is a desirable material but must be matched to properties of cast iron and/or made wear resistant. Also, although silicon carbide has been described as the ceramic particle material, other materials may be used such as titanium carbide, alumina, titanium or aluminum nitride, or other particles. The specific choice would depend upon the specific properties desired. It is therefore intended that the scope of the present invention is to be limited only by the scope of the appended claims.

What is claimed is:

1. A scroll machine means comprising:

a first scroll means made of ceramic particle reinforced aluminum metal matrix composite including a wrap and a floor portion with said wrap having flanks and a tip;

a second scroll means including a wrap and a floor portion with said wrap of said second scroll means having flanks and a tip;

means for driving said first scroll means so as to have flank sealing contact between said first and second scroll means;

axial compliance means for causing said tip of said first scroll means to be in direct sealing contact with said floor portion of said second scroll means and for causing said tip of said second scroll means to be in direct sealing contact with said floor portion of said first scroll means.

2. The scroll machine means of claim 1 wherein said ceramic particle reinforced aluminum metal matrix includes 10–25% by volume of silicon carbide.

3. The scroll machine of claim 1 wherein said second scroll means is made of cast iron.

4. The scroll machine of claim 1 wherein said second scroll means is made of aluminum metal matrix composite.

* * * * *